United States Patent [19]

Dietz et al.

[11] 4,113,095

[45] Sep. 12, 1978

[54] TRAY-TYPE PROCESSED FOOD CONTAINERS

[75] Inventors: Raymond A. F. Dietz; Danny L. Fundom, both of Massillon; George J. Henning, Canton; Lynn B. McKinney, Massillon, all of Ohio

[73] Assignee: Van Dorn Company, Cleveland, Ohio

[21] Appl. No.: 744,965

[22] Filed: Nov. 26, 1976

[51] Int. Cl.[2] ..... B65D 21/02; B65D 7/48; B65D 7/46

[52] U.S. Cl. ..... 206/508; 206/518; 206/519; 220/72; 220/74

[58] Field of Search ..... 220/71, 72, 73, 74; 206/508, 518, 519, 520

[56] References Cited

U.S. PATENT DOCUMENTS

| | | | |
|---|---|---|---|
| 1,079,903 | 11/1913 | Norton | 206/518 |
| 3,098,597 | 7/1963 | Johnson | 220/72 |
| 3,104,044 | 9/1963 | Reifers | 206/518 |
| 3,884,383 | 5/1975 | Burch | 220/74 |

FOREIGN PATENT DOCUMENTS

| | | | |
|---|---|---|---|
| 230,795 | 12/1963 | Austria | 220/74 |
| Ad.7,020 | 12/1876 | Canada | 220/72 |
| A58,857 | 4/1954 | France | 220/72 |
| 1,405,019 | 9/1975 | United Kingdom | 206/518 |
| 572,551 | 10/1945 | United Kingdom | 206/508 |
| 27,259 of | 1902 | United Kingdom | 220/72 |

*Primary Examiner*—George E. Lowrance
*Attorney, Agent, or Firm*—Frease & Bishop

[57] ABSTRACT

A half-size sheet metal steam table tray and a lid that may be joined by a sealed double seam to the tray to form a container for packing or canning, processing, storing, shipping, distributing, heating, displaying and serving processed food products in any desired manner, and particularly for use at a steam table. The tray and lid container is desirable for institutional use to replace 105 fluid ounce capacity No. 10 cans for processed foods or frozen food containers. The tray serves as a cooking vessel suitable for heating the food product packed therein after removal of the lid and before serving. The tray becomes a serving container replacing stainless steel serving pans commonly used in volume feeding establishments.

6 Claims, 16 Drawing Figures

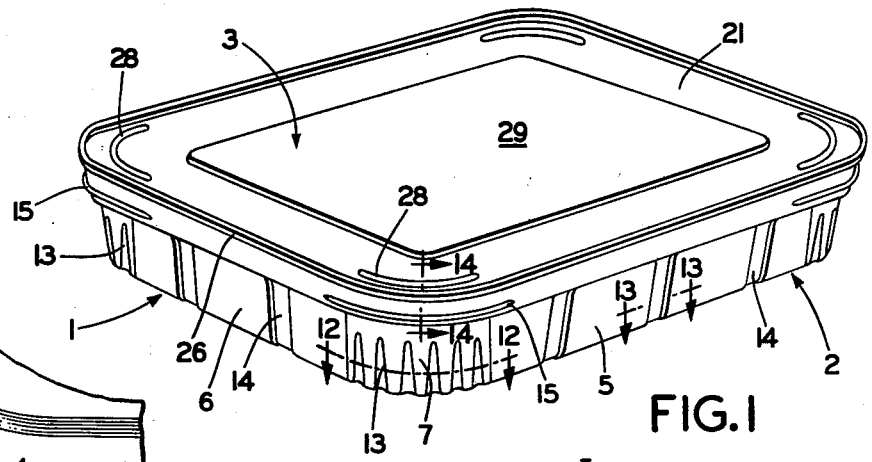
FIG. 1
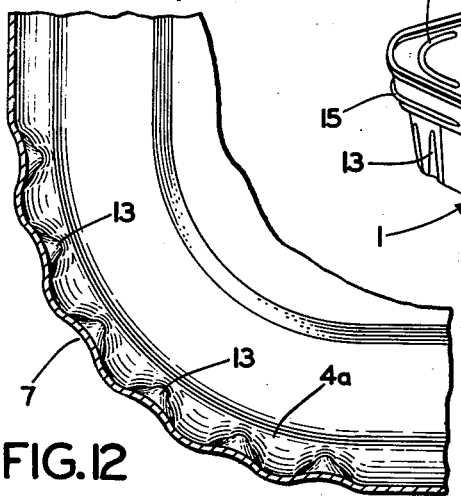
FIG. 12
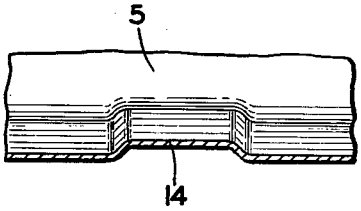
FIG. 13
FIG. 14
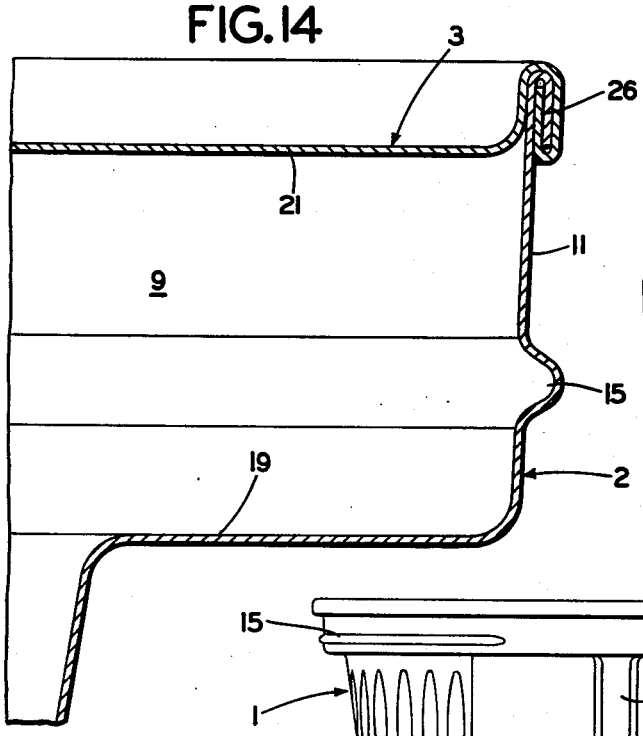
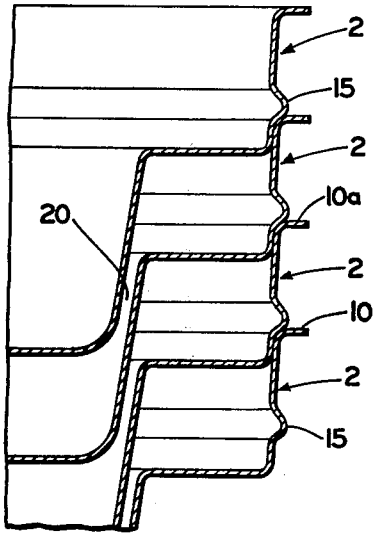
FIG. 15
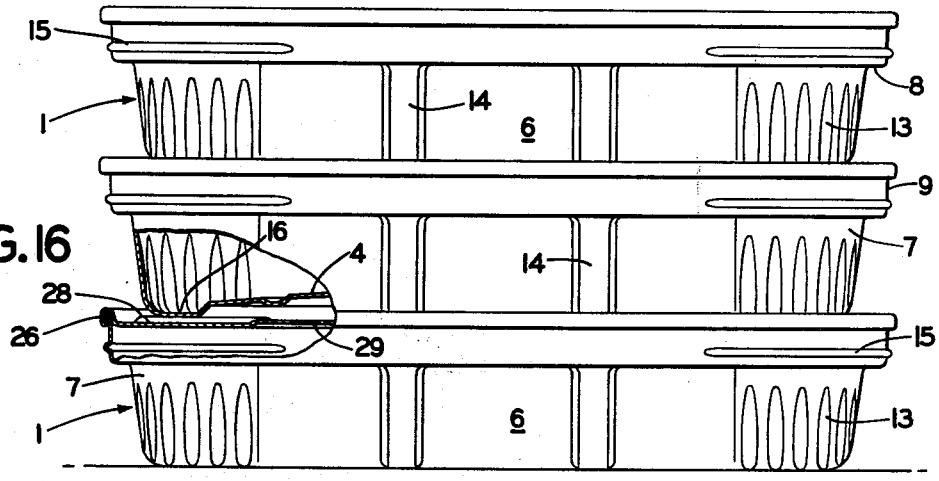
FIG. 16

TRAY-TYPE PROCESSED FOOD CONTAINERS

BACKGROUND OF THE INVENTION

1. Field of the Invention

The invention relates to a container for processing foods providing not only the package in which the food product is packed, processed and distributed to the point of use in the food service industry; but also providing the vessel in which the food may be heated at the point of use, and from which the heated food may be directly served at a steam table or other serving center. Processing food in the traditional No. 10 cans takes a relatively long time, which may affect the flavor, texture and color of the food product being heated; and thus the invention further relates to a container construction in which food products may be processed more rapidly than in No. 10 cans.

More particularly, the invention relates to a tray-type processed food container which has many advantages in use in standard food service systems as compared either with the use of the traditional No. 10 can or as compared with the use of frozen food packages. Further, the invention relates to a new construction and arrangement of tray-type processed food containers which are characterized in use by improved food product quality, faster processing time, reduced energy costs for heating, and expanded use as containers for types of food which do not lend themselves to standard processing in No. 10 cans.

2. Description of the Prior Art

Traditionally, No. 10 cans have been used with stainless steel serving trays in standard systems in the food service industry for serving processed foods in a steam table. Prior systems involve heating the processed foods in a second vessel; and after heating, the food is emptied from the vessel into serving containers, normally a stainless steel serving pan commonly used in volume feeding establishments and located at a food service steam table. This prior procedure also requires washing and cleaning the commonly used serving pans after each use. The cost of pan cleaning may amount to fifty cents per pan.

Other prior food service systems use frozen foods and involve time-consuming thawing, which can slow down food service under sudden overload demand at a serving station. Further, the frozen food service systems require investments in freezing equipment for storing the packages of frozen foods. Possible losses, and therefore higher unit food prices may be involved because of premature thawing of frozen foods on unloading docks or at any point in the distribution of frozen foods from the packer to the point of use. In addition, the cost of a food product is increased by the cost of freezing them and keeping them frozen during distribution.

Accordingly, there is an existing need in the food service industry to eliminate the disadvantage of the traditional use of the No. 10 can for processed food containers, and for eliminating the described disadvantages characterizing the use of frozen processed foods in food service systems.

SUMMARY OF THE INVENTION

Objectives of the invention include providing a new tray-type container construction for processed foods, which container forms the packing container for processed foods, as well as the heating vessel for the food contained in the tray before serving, and finally also forms the food serving container which may be used at a steam table; providing such a tray-type processed food container construction which eliminates the need for conventional serving pans at a steam table, thereby eliminating the need for and the cost of washing such conventional serving pans after each use; providing such a tray-type processed food container construction in which the foods are shelf-stable and ready to be heated and served, eliminating the need for time-consuming thawing of frozen foods heretofore sometimes used in the food service industry; providing such a tray-type processed food container construction which eliminates investments in freezing equipment required where frozen foods are used in the food service industry; providing such a tray-type processed food container construction which reduces energy costs in the food service industry as compared either with the cost of heating processed foods in No. 10 cans, or freezing costs of the foods and for keeping the foods frozen where frozen foods are involved; providing such a tray-type processed food container construction in which the food contained therein may be rapidly processed with reduced energy costs and which may be used for serving such foods as sliced meats, sweet potatoes, stuffed peppers, whole fruits, etc. which do not lend themselves to standard processing in No. 10 cans; providing such a tray-type processed food container construction which in use results in substantial improvement in the flavor, texture and color of the served foods packed therein when served after heating as compared with the use of prior cans; and providing a new tray-type processed food container construction which eliminates difficulties heretofore encountered in the food service industry, achieves the indicated objectives simply, effectively and inexpensively, and solves existing problems and satisfies existing needs in the food service industry.

These objectives and advantages are obtained by the sheet metal tray-type container construction for processing foods, the general nature of which may be stated as including a one-piece tray and a tray lid seamed to the tray; the tray including light gauge sheet metal, bottom, side and end walls forming a generally rectangularly-shaped tray; the side and end walls being connected by curved corner walls; an outturned continuous ledge formed at upper ends of the side, end and curved corner walls; said side, end and curved corner walls tapering upward outward between the bottom wall and ledge; second side, end and curved corner wall portions offset laterally outward of the first mentioned side, end and curved corner walls extending upward from the perimeter of the ledge and forming the upper open end of the tray; said second wall portions having an outturned continuous terminal bead-forming flange at the open end of the tray; each second curved corner wall portion having a smaller radius of curvature than that of any of the first mentioned curved corner walls to provide widened ledge portions at each corner of the tray; each first mentioned tray curved corner wall being formed with vertical column-like reinforcing means; there being a plurality of inwardly embossed vertically extending reinforcing means formed in spaced relation in each of the first mentioned tray side and end walls extending between the tray bottom wall and ledge; the bottom wall having a flat horizontally oriented rectangular band-like zone extending inward from the first mentioned tray side, end and corner walls; the tray when placed on a flat surface being adapted to rest on said flat, band-like zone; the tray having a capacity to contain 105 fluid ounces of water or its equivalent volume of food product; the ledge depth below the terminal bead-forming flange being predetermined such that the fluid level of 105 fluid ounces of product is located above the ledge; there being a horizontally oriented corrugation embossed outwardly in each second curved corner wall portion; the tray lid including a rectangular panel extending from a recessed corner formed by a continuous upstanding wall having outturned bead-forming flange means seamed to the continuous terminal bead-forming tray flange; the rectangular lid shape matching the shape of the open upper end of the tray; and the lid upstanding recessed corner-forming wall being telescoped within the second wall portions of the tray.

BRIEF DESCRIPTION OF THE DRAWINGS

A preferred embodiment of the invention — illustrative of the best mode in which applicants have contemplated applying the principle — is set forth in the following description and shown in the accompanying drawings, and is particularly and distinctly pointed out and set forth in the appended claims.

FIG. 1 is a perspective view of the new tray-type container construction;

FIG. 12 is an enlarged fragmentary sectional view taken on the line 12—12, FIG. 1;

FIG. 13 is an enlarged fragmentary sectional view taken on the line 13—13, FIG. 1;

FIG. 14 is an enlarged sectional view taken on the line 14—14, FIG. 1;

FIG. 15 is a fragmentary sectional view of parts of a series of tray components stacked in nested condition for shipping; and FIG. 16 is a view of three containers stacked on one another with parts broken away and in section.

Similar numerals refer to similar parts throughout the drawings.

DESCRIPTION OF THE PREFERRED EMBODIMENT

Figure 2:
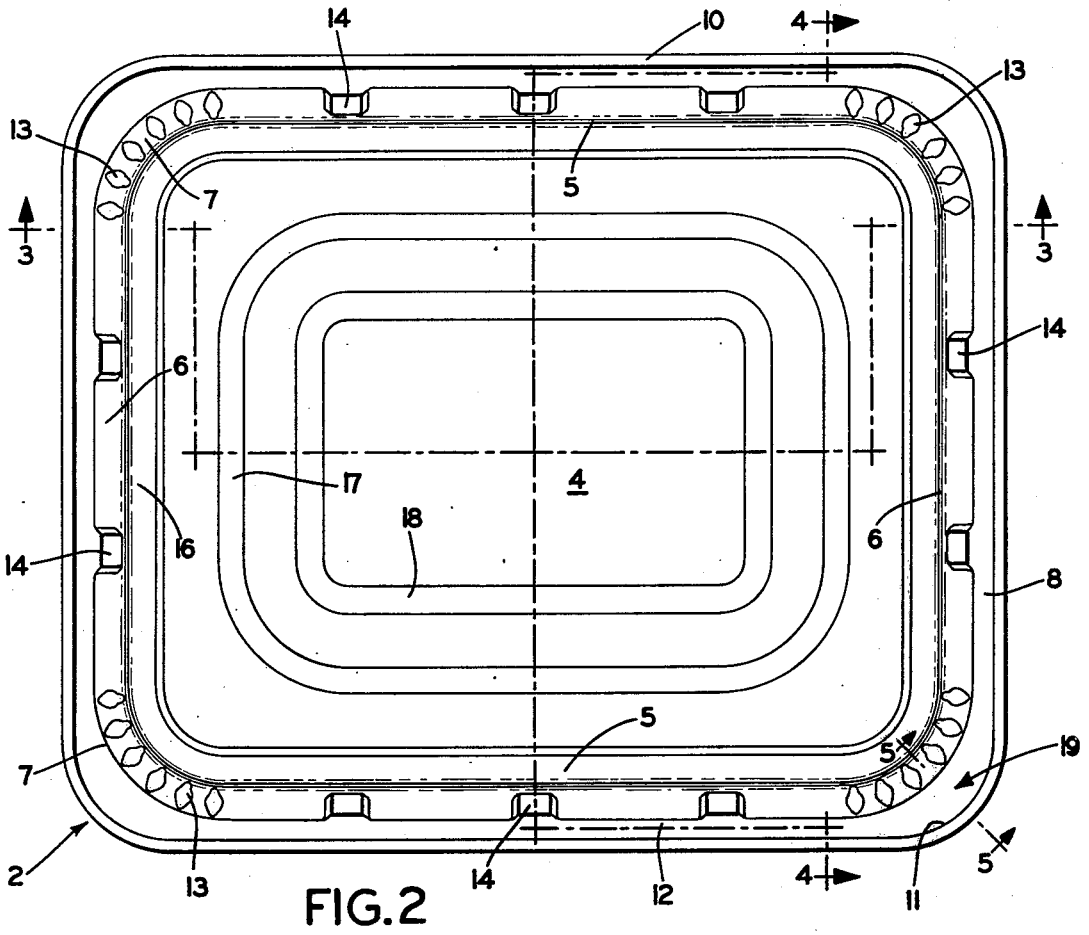
FIG. 2 is a top plan view of the tray component of the container shown in FIG. 1.
Figure 3:
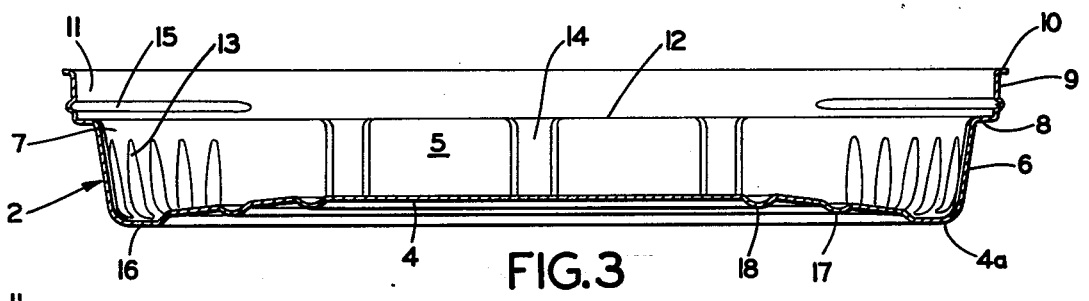
FIG. 3 is a section taken on the line 3—3, FIG. 2.
Figure 4:
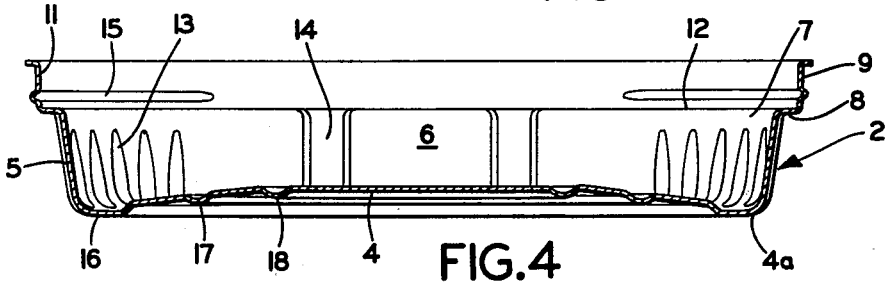
FIG. 4 is a section looking in the direction of the arrows 4—4, FIG. 2.

The improved tray-type processed food container is illustrated generally at 1 in FIG. 1 and includes a tray generally indicated at 2 and a tray lid generally indicated at 3. The tray 2 is generally rectangular in shape and is formed from sheet metal as a shallow pan-like structure having a bottom wall 4 with upstanding side and end walls 5 and 6, respectively. The side and end walls 5 and 6 are slightly upwardly outwardly tapered for draft during press forming the tray 2 from light gauge sheet metal and to permit nested stacking of the trays 2 during manufacture and prior to filling with a food product. The nesting is illustrated generally in FIG. 15. The side and end walls 5 and 6 are joined by large sweepingly curved corner walls 7 (FIG. 12).

Figure 6:
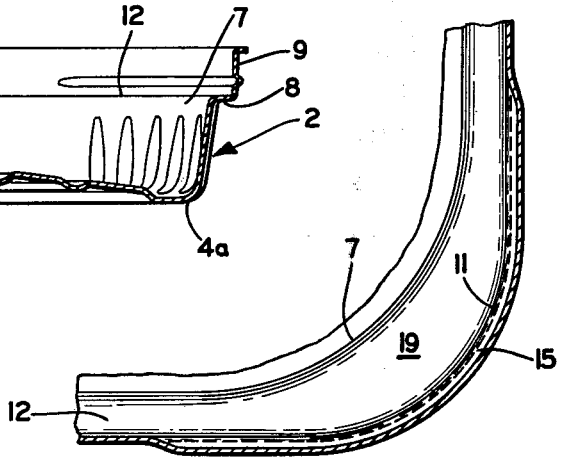
FIG. 6 is a fragmentary section taken on the line 6—6, FIG. 5.

The upstanding side, end and corner walls 5, 6 and 7 are formed at their upper ends with a continuous, outwardly projecting horizontal flange 8 which terminates in an upwardly projecting continuous, rectangular wall 9 which in turn terminates in an outturned terminal flange 10. The upwardly projecting wall 9 also is formed with curved corner portions 11 above the tray corners 7. The corner portions 11 are curved on a radius smaller than that of the corners 7, as best shown in FIG. 6.

The outturned horizontal flange wall 8 extending continuously around the upper tray portion spaced below the open end of the container forms a continuous ledge 12 spaced preferably a predetermined distance below the terminal tray flange 10.

A series of tapered flutes 13, curved in cross section, are formed in each sweepingly curved corner wall 7 extending upward from the curved corner **4*a* between the curved corner wall 7 and bottom wall 4 to the ledge 12 (FIGS. 1, 2, 3, 4 and 12**).

Figure 5:
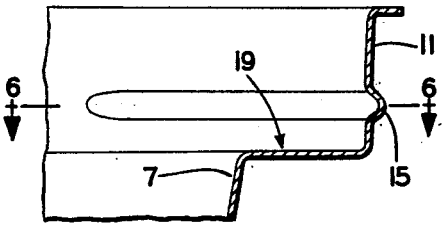
FIG. 5 is an enlarged fragmentary section looking in the direction of the arrows 5—5, FIG. 2.

A number of wide vertically extending flat flutes 14 embossed inwardly of the walls are formed in the side and end walls 5 and 6 extending upwardly from the bottom wall 4 to the ledge 12 (FIGS. 1, 3, 4 and 13). A horizontally-oriented corrugation 15 is embossed outwardly in each corner portion 11 of the tray 2 (FIGS. 5 and 6).

The bottom wall 4 has a flat horizontally-oriented bandlike rectangular shape 16 defining and extending inward from the corners between the bottom wall 4 and side, end and corner walls 5, 6 and 7. The pan rests on this flat band 16 when placed on a table, stove rack, or the like. The bottom wall portion inside the band 16 is slightly concave exteriorly upwardly, and preferably has formed therein several downwardly embossed corrugations 17 and 18 generally rectangular in shape.

The ledge portions 19 (FIGS. 2 and 6) at the corners of the tray 2 between the curved corner walls 7 and the curved corner portions 11 are laterally wider than the remainder of the ledge, as shown.

The corner flutes 13, the side and end wall flutes 14, the bottom wall embossments 17 and 18, the height of the upwardly projecting wall 9 above ledge 12, the horizontal corner corrugations 15, the wider corner ledge portions 19, the upward outward taper of the side and end walls 5 and 6, the exterior concavity of the bottom wall 4, and the coordination of and cooperative relation between these items impart important attributes to the improved tray 2.

The corner flutes 13 provide vertical column-like strength to the container at the tray corners 7 to sustain loading of the filled containers when stacked and damage thereto during shipping. These corner flutes 13 also strengthen the container corners 7 against any accidental blows imparted to the containers sidewise of the corners. Finally, the corner flutes 13 assist in preventing corner collapse when the filled and closed containers are heat-processed to cook the food and place the food contained in the container under vacuum.

The flat flutes 14 in the tray side and end walls 5 and 6 assist in providing vertical strength to the containers during shipping and when stacked. The flutes 14 also prevent a so-called "oil-can" effect. The flutes eliminate loose metal that can diaphragm under pressure and which can indicate absence of vacuum if the oil-can effect is permitted to occur.

The embossed corrugations 17 and 18 in the bottom wall 4 and the exterior concavity of the bottom wall 4 assist in supporting the weight of the food contents of the container during shipment and minimize a possible source of container damage. The exteriorly concave bottom wall 4 will belly outward during heating of the container to process food therein, but will return to original form during cooling as vacuum is established. The concave feature and embossed corrugations 14 prevent buckling of the bottom wall 4 during heat processing.

The predetermined height of the wall 9 above the ledge or shoulder 12, or in other words the depth of the ledge or shoulder 12 below the terminal flange 10, has several important functions. The tray 2 is designed to be filled with 105 fluid ounces of food products, the same amount as is provided by a No. 10can previously traditionally used in the processed food service industry.

The tray 2 is designed so that the fill height or level of the food product in the tray is established above the ledge 12 to permit the food contents of the tray 2 to be heated after the container has been opened without the food contents drying on or burning on the ledge 12. Thus, the depth of the food product in the tray permits flow of such product above the ledge and avoids drying of the product on the ledge.

Coordinated with the predetermined depth of ledge 12 is the fact that the ledge depth permits the container, as shown in FIGS. 1 and 14, to be opened by any commercial can opener without piercing the metal in the flange wall 8 which forms the ledge 12. The depth of the ledge 12 is designed to provide ⅛ inch clearance below the location of any known style of can opener knife when used to open the container. Finally, the shoulder or ledge 12 provides a means for supporting the tray 2 when placed in a steam table for serving processed food products contained in the tray 1.

Referring to FIG. 15, the horizontal corner corrugations or rigs 15 support the trays 2, one above another, in nested condition for handling during manufacture and shipping. The empty trays 2, as shown in FIG. 15, may be nested within one another without sticking or wedging together. This eliminates body contact and provides clearance at the zone 20 between the interior surfaces of the side and end walls 5 and 6 of one tray and the exterior surfaces of the side and end walls 5 and 6 of the tray next above. Maintaining such clearance 20 reduces the possibility of damage to the coating on the interior of the tray from scratching, rubbing, or the like, and thus maintains the integrity of the interior tray protective coating. The corner corrugations or ribs 15 also reinforce the corners in the curved corner portions of the upwardly projecting wall 9.

The corner ribs 15 also add to the total flexibility of use of the tray 2. Steam table openings may vary beyond the practical limits of the ledge 12 and ledge corners 19. The outwardly embossed corner ribs 15 add to the range of steam table openings which the tray 2 will safely fit.

A further feature of the stacking and nesting function of the corner ribs 15 is to permit a nested stack of trays 2, as shown in FIG. 15, to be readily handled in a packing plant at a food filling station in a filling line. A fork-like member in a food filling line mechanism may be inserted below the terminal flange 10 of the next to the bottom tray in a stack, such as indicated at 10*a* in FIG. 15, permitting the bottom tray in the stack to drop from the stack to a conveyor which transports the tray to a food filling station where 105 fluid ounces of food products may be discharged to fill the tray.

The wider ledge corners 19 formed on the tray serve several functions. First of all, they provide convenient means for picking up and handling a filled container 1 at any time during distribution, heating, or placement in a steam table. Further, they assist in covering the square corners of openings in a steam table when the trays containing processed foods are placed in a steam table.

The tray lid 3 (FIGS. 7–11) also is formed of light gauge sheet metal and is designed to cooperate with the improved tray 2 to achieve the various objectives of the new tray-type processed food container 1 as a closure for such container. The lid 3 is generally rectangular in shape, matching the shape of the open upper end of the tray 2. The lid 3 has a panel 21 extending from a recessed corner 22 formed by an upstanding wall 23 which terminates in an outturned flange 24 having a surrounding downturned terminal flange 25. In securing and sealing the tray lid 3 to a tray 2, the recessed lid corner 22 and upstanding wall 23 are telescoped within the tray wall 9 and over the terminal tray flange 10. A usual double seaming operation is carried out to form the double seam 26, as shown in FIG. 14.

Figure 11:
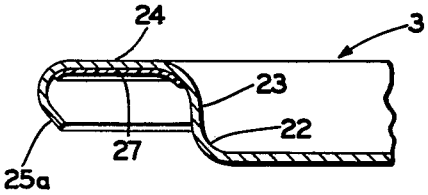
FIG. 11 is a fragmentary view similar to a portion of FIG. 10, showing the sealing compound applied to the lid before the lid is seamed to the tray to form the container shown in FIG. 1.
Figure 10:
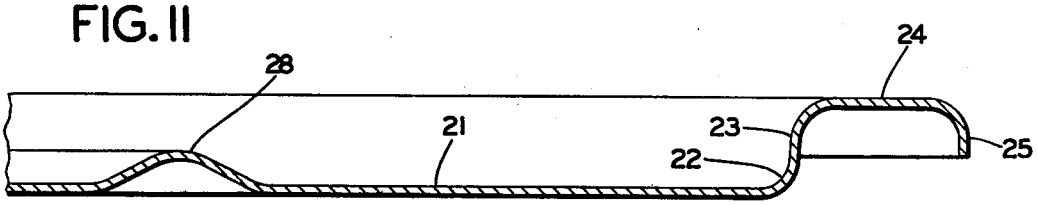
FIG. 10 is an enlarged fragmentary sectional view looking in the direction of arrows 10—10, FIG. 7.

Prior to forming the double seam, a sealing compound lining 27 is applied to the lid on the underside of the outturned flange 24 and between wall 23 and terminal flange 25. This is shown in FIG. 11, where the terminal flange also is shown to be rounded as indicated at 25*a*. This reforming of flange 25*a* takes place prior to or as a part of the double seaming operation.

Figure 7:
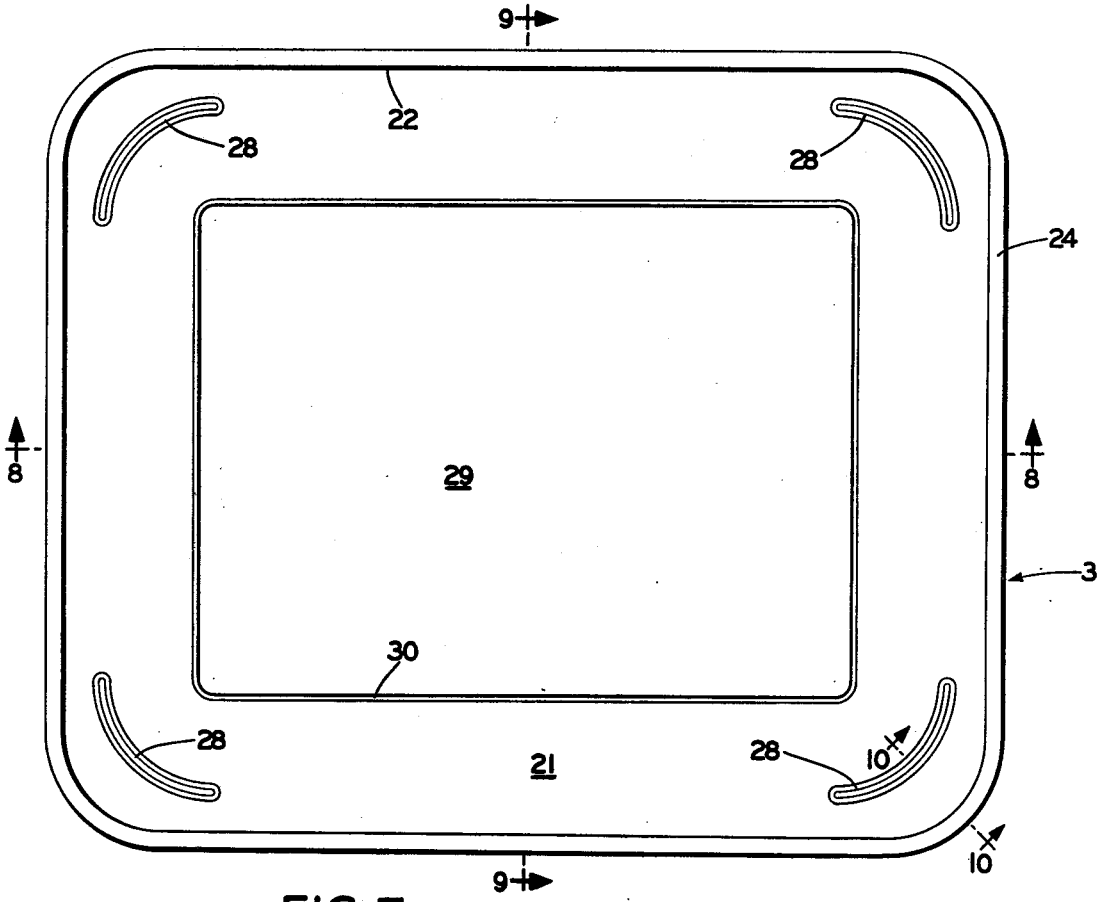
FIG. 7 is a top plan view of the lid component of the new container construction.
Figure 8:
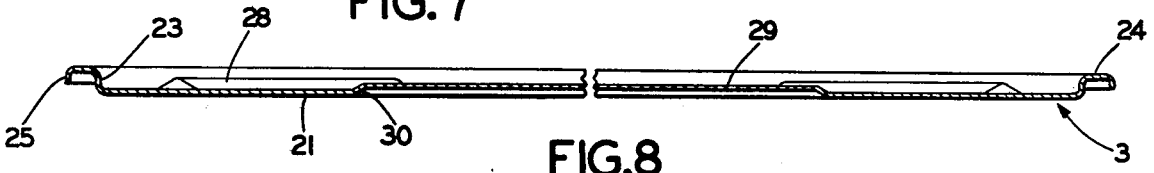
FIG. 8 is a section looking in the direction of the arrows 8—8, FIG. 7.
Figure 9:
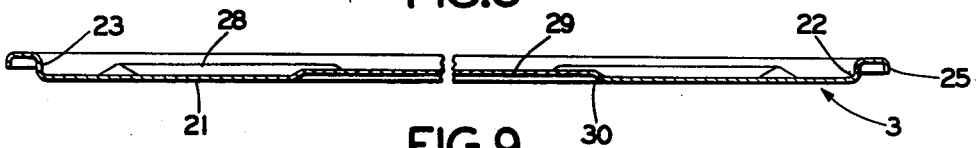
FIG. 9 is a section looking in the direction of arrows 9—9, FIG. 7.

The lid panel 21 preferably is provided with an upwardly embossed curved bead or rib 28 adjacent each corner. Bead 28 preferably is formed on approximately the same radius of curvature as the curved corner 7 of the tray 2. Beads 28 preferably are located in positions aligned above the upper curved corners of the tray when the lid 3 and tray 2 are connected together. The lid 3 also may have a panel portion 29 embossed upwardly as at 30 in the lid panel 21 (FIG. 7).

The lid corner beads 28 impart rigidity to the lid in areas normally susceptible to buckling during heat processing of foods in a container 1 due to the espansion of gases present within the container 1 above the food level therein. If such buckling is permitted to take place, not resisted by corner beads 28, the lid metal may take a permanent set in buckled position. The increased lid rigidity, avoiding buckling, provides more latitude in the pressure control within the container 1 during heat processing.

The depth of the recessed lid corner 22 is predetermined and designed to accept all known commercial can opening mechanisms for opening container 1 before heating at a place of food service use.

The central embossed lid panel 29 adds to the stiffness strength of the lid and takes up metal during the press-forming of the lid, which metal take-up and stiffness cooperate with the corner beads 28 in imparting rigidity to the lid to resist buckling.

The tray and lid, as stated, are formed of light gauge sheet metal which may be tin-free steel or aluminum or tin-plate. Inside surfaces of the tray 2 and lid 3 may be coated with a usual enamel lining material used to line metal food containers. The outer surfaces of the tray 2 and lid 3 also may be provided with a usual enamel coating.

In use, trays such as the tray 2 of FIG. 2 and lids such as the lid 3 of FIG. 7 are obtained by a canner from a can company, and the trays are filled with food products substantially in the same manner as No. 10 cans are filled with food products. After filling, the lids 3 are seamed at 26 to the trays 2 and the sealed containers 1 are subjected to processing heat to penetrate the center of the food product in the trays to achieve sterility and to provide vacuum in the tray-container when cooled.

It has been discovered that it takes 60% less time to heat the improved container 1 than to heat a No. 10 can where both the container 1 and No. 10 can are filled with the same amount of the same food product. Further, if the container 1 is rotated during cooking, the reduced time of heating can even be greater. This saves energy costs and is accompanied by a substantial improvement in the flavor, texture and color in the food product because of less time requirements for the processing heat to penetrate the center of the food contained in the tray-type container.

Another advantage of the improved tray-type container construction is that it may be used for such foods as sliced meats, sweet potatoes, stuffed peppers, whole fruits, and other similar food products, which do not readily lend themselves to standard processing in No. 10 cans.

The tray-type container 1, like a No. 10 can, may be opened by any known can opener in use today, but here the similarity ends with respect to use of the two different types of containers in the food service industry.

The tray 2 also serves as a cooking container, suitable for heating in most conventional ovens. The tray becomes the serving container, thereby taking the place of stainless steel serving pans commonly used in volume feeding establishments.

This eliminates the need for washing the prior serving pans after each use, which thus eliminates the cleaning costs which may amount to fifty cents per cleaning per pan.

Food products in the improved tray-type container are shelf-stable and ready to heat and serve. As compared with frozen foods, there is no need for time-consuming thawing. Thus, overload feeding situations at a food service station can be handled more rapidly and without waste by opening and heating additional trays as actually required.

As compared with frozen foods, there is no danger of premature thawing after freezing and during distribution. Energy costs and savings also accrue in that freezing after heat-processing is eliminated, and investments in freezing equipment and frozen food storage units are eliminated.

Accordingly, the improved tray-type processed food containers achieve the objectives described, have the advantageous characteristics set forth, and provide the new results indicated.

In the foregoing description, certain terms have been used for brevity, clearness and understanding; but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved structure is made, the characteristics of the new construction, and the advantageous, new and useful results obtained; the new and useful structures, devices, elements, arrangements, parts, combinations, and subcombinations are set forth in the appended claims.

We claim:

1. One-piece tray construction for processed food containers including light gauge sheet metal, bottom, side and end walls forming a generally rectangular tray; the tray having an outer surface and an inner surface provided with a protective coating; the side and end walls being connected by curved corner walls; an outturned continuous ledge formed at the upper ends of the side, end and curved corner walls; said side, end and curved corner walls tapering upward outward between the bottom wall and ledge; second side, end and curved corner walls offset laterally outward of the first mentioned side, end and curved corner walls extending upward from the perimeter of the ledge and forming the upper open end of the tray; said second walls having an outturned continuous terminal bead-forming flange at the open end of the tray; each second curved corner wall having a smaller radius of curvature than that of any of the first mentioned curved corner walls to provide widened ledge portions at end corner of the tray; horizontally oriented corrugation means embossed outwardly in each of said second curved corner walls; and said corner corrugation means being adapted to engage and be supported on the outturned terminal beadforming flange of a tray next below when a series of trays are stacked in nested condition, with the outer surfaces of the first mentioned side, end and curved corner walls of adjacent trays in the nested stack being spaced from the inner protective coated surfaces of the trays next below.

2. The construction defined in claim 1 in which the bottom wall has a flat horizontally oriented rectangular band-like zone extending inward from the first mentioned tray side, end and corner walls; in which the tray when placed on a flat surface is adapted to rest on said flat, band-like zone; in which the bottom wall portion inside the band-like zone is normally slightly upwardly concave, whereby said concave portion is adapted to expand outwardly when the contents of the tray construction is heated.

3. The construction defined in claim 1 in which a tray lid is seamed to the tray; in which the tray lid includes a rectangular panel extending from recessed corners formed by a continuous upstanding wall having outturned bead-forming flange means seamed to the continuous terminal bead-forming tray flange; in which the rectangular lid shape matches the shape of the open upper end of the tray with the lid upstanding recessed corner-forming wall being telescoped within the second walls of the tray; and in which an upwardly embossed curved bead is formed in the lid panel adjacent to and spaced from each lid corner.

4. The construction defined in claim 3 in which the curved lid beads each have a radius of curvature generally equal to the radius of curvature of the first-mentioned curved corner walls of the tray; and in which said curved lid beads are located generally vertically above said first-mentioned curved corner tray walls.

5. The construction defined in claim 3 in which the outturned ledge of the tray is located beneath the tray lid a sufficient distance to form a space for receiving some of a fluid food product contained within the container construction.

6. The construction defined in claim 1 in which the tray has a capacity to contain approximately 105 fluid ounces of a fluid food product.

* * * * *